United States Patent [19]

Shuttleworth

[11] Patent Number: 4,516,450

[45] Date of Patent: May 14, 1985

[54] SLUG-RETAINING DIE

[75] Inventor: Edwin T. Shuttleworth, Point Pleasant, N.J.

[73] Assignee: Wilson Tool Company, White Bear Lake, Minn.

[21] Appl. No.: 472,282

[22] Filed: Mar. 7, 1983

[51] Int. Cl.[3] ..... B26F 1/14

[52] U.S. Cl. ..... 83/146; 83/345; 83/685; 83/690

[58] Field of Search ..... 83/690, 145, 670, 345, 83/685, 680, 146

[56] References Cited

U.S. PATENT DOCUMENTS

| | | | |
|---|---|---|---|
| 2,369,896 | 2/1945 | Harris et al. | 83/685 |
| 2,404,793 | 7/1946 | Dickerman | 83/685 |
| 2,604,167 | 7/1952 | Oliver | 83/690 |
| 3,142,115 | 7/1964 | Schaming | 83/690 |
| 3,296,905 | 1/1967 | Killaly | 83/685 |
| 3,358,538 | 12/1967 | Maceyka | 83/690 |
| 3,910,213 | 10/1975 | Hoenig et al. | 83/685 |
| 4,048,890 | 9/1977 | Aeschbach | 83/685 |
| 4,248,111 | 2/1981 | Wilson et al. | 83/140 |
| 4,273,015 | 6/1981 | Johnson | 83/690 |

*Primary Examiner*—Frank T. Yost
*Assistant Examiner*—Hien H. Phan
*Attorney, Agent, or Firm*—James R. Haller

[57] ABSTRACT

The die of a punch press is provided with at least one inwardly-extending protrusion elongated in the direction of travel of the punch and positioned to encounter and grip the edge of a punched slug of workpiece material during the punching step and to restrain the slug from following the punch during the retraction step of the punch.

6 Claims, 11 Drawing Figures

Fig. 7
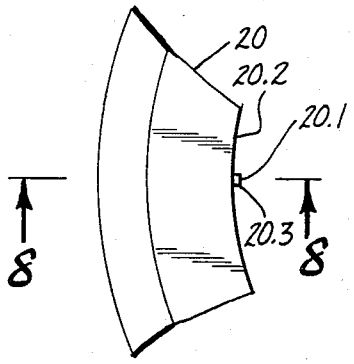
Fig. 8
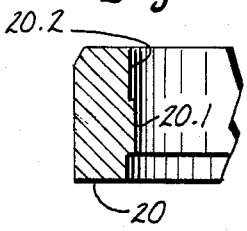
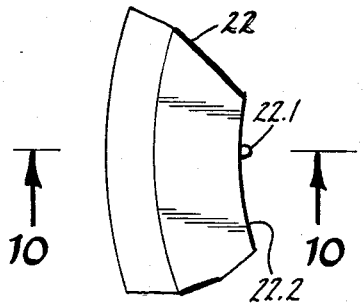
Fig. 9
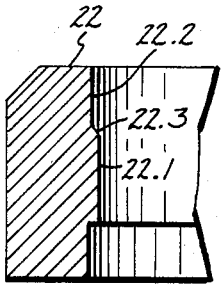
Fig. 10
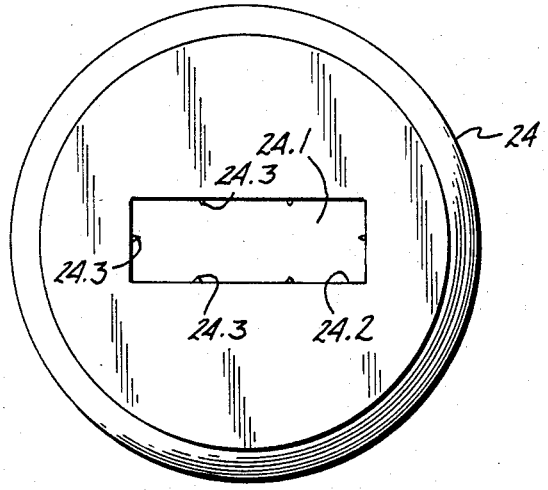
Fig. 11

SLUG-RETAINING DIE

FIELD OF THE INVENTION

This invention relates generally to the field of workpiece machining operations, and particularly to punch presses.

BACKGROUND OF THE INVENTION

"Slug-pulling" is a recurring problem in the operation of high speed punch presses. "Slugs" are the pieces of metal that are punched from workpieces in a punch press operation; "slug-pulling" refers to the tendency of slugs to follow the punch head in its return stroke, the slug ending up at or near the plane of the workpiece and giving rise to a variety of problems as the workpiece is moved quickly past the punch and die in subsequent punching operations. The slug-pulling problem is particularly severe when small-sized punches and dies are employed, and can cause considerable down time and loss of production. The latter is particularly evident upon consideration of the fact that modern day punch presses often operate in the range of from about 200 to about 400 strokes per minute.

Historically, the die opening dimensions are set at values exceeding the dimensions of the hole to be punched in a workpiece by about 8% of the workpiece thickness. One finds that the diameter of the hole thus punched increases from the punch side to the die side of the workpiece, the punch side of the hole having dimensions of the punch and the die side of the hole having the dimensions of the die opening. The slugs that are formed accordingly have overall dimensions that are larger than the punch side dimensions of the punched hole, and it is not uncommon, as a slug follows the punch during the return stroke of the punch, for the slug to become wedged or lodged in the hole from which it was punched, thereby interferring with subsequent movement of the workpiece. It is often necessary to resharpen the punch tips, and it has been found that the propensity of punch tips to become dulled decreases if the die opening dimensions are increased so as to exceed the dimensions of the hole to be punched in the workpiece by as much as 20% of the workpiece thickness. The resulting increase in die opening dimensions also serves to accentuate the dimensional differences between the punch side and die side of a punched hole, thereby rendering the slug-pulling problem more severe.

Various means have been adopted to retard or prevent the slug-pulling problem. Punches themselves may be provided with centrally positioned slug-ejector rods for the purpose of separating the slug from the face of the punch head and ejecting the slug from the die during each punching cycle. Because of the expense involved in manufacturing punch heads with separately moveable ejector pins, and because of the rather poor results obtained with such devices, this solution to the slug-pulling problem has not gained wide popularity.

Another solution involves the use of a heavy grease or the like within the die to adhere the slug to the die and prevent it from following the punch head during the punch head's return stroke. This solution to the slug-pulling problem has not gained wide popularity.

BRIEF DESCRIPTION OF THE INVENTION

The invention relates to a slug-retaining punch press die having an opening receiving a punch during punching and retraction steps in a material punching operation. The die includes at least one inwardly-extending protrusion elongated in the direction of travel of the punch head and adapted to encounter and grip the edge of a punched slug of workpiece material during the punching step and to restrain the same from following the punch during the retraction step.

In a preferred embodiment, the die includes a plurality of such protrusions spaced about its interior and spaced below the punch-facing surface of the die. Preferably, the gripping protrusions extend inwardly of the die to a point sufficient to bring such protrusions into contact only with the expanded periphery of the slug. As used herein, "expanded periphery" of the slug refers to that portion of the periphery of the slug which extends beyond the related dimensions of the punch, it being understood that the dimensions of the slug across its punch-facing surface will be slightly smaller than its dimensions on its other surface.

DESCRIPTION OF THE DRAWING

FIG. 7 is a top, broken-away view of a modified die of the invention;

FIG. 8 is a broken-away, cross-sectional view taken along line 8—8 of FIG. 7;

FIG. 9 is a top, broken-away view of yet another modified die of the invention;

FIG. 10 is a broken-away, cross-sectional view taken along line 10—10 of FIG. 9; and FIG. 11 is a plan view of another modification of the die of the invention.

DETAILED DESCRIPTION

Referring first to FIGS. 2–5, a die and punch are designated respectively as (12) and (14), the die having a generally circular die opening (12.1). For ease of understanding, the embodiments of the invention typified in FIGS. 1–10 are described in terms of circular dies and punches; it will be understood, however, that the dies and punches can be of varying shapes of the type known in the field.

Figure 1:
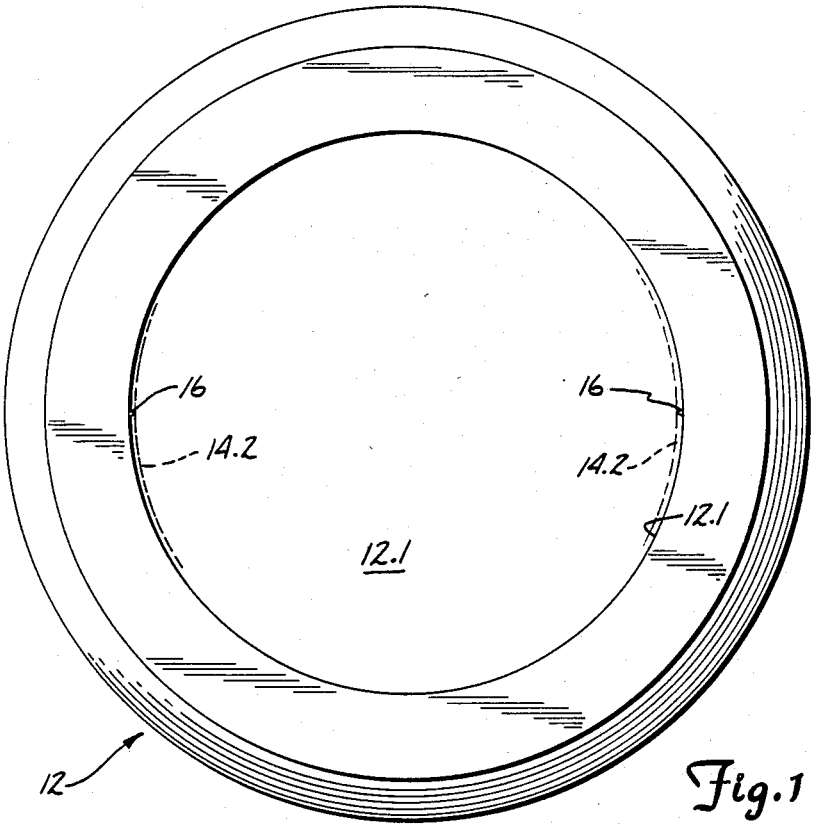
FIG. 1 is a top view of a die of the invention.

As shown in FIG. 1, the die opening (12.1) has a diameter "D" that is slightly greater than the diameter "d" of the punch, the difference in diameters depending upon the thickness of the workpiece to be punched and typically ranging from perhaps 8% to about 20% of the thickness of the workpiece. The circular bore (12.2) formed through the die preferably is of the same diameter as the die opening (12.1), and it will be understood that the die and punch commonly are of hardened steel or steel alloys with the die opening (12.1) and the punch rim (14.1) having sharp edges.

Shown at (16) in FIGS. 2–5 are small protrusions extending inwardly of the die bore (12.2), the protrusions being formed on opposing sides of the bore. In the embodiment of FIGS. 1–5, the protrusions are generally triangular in shape as viewed from above (FIG. 1) and terminate inwardly in sharp edges (16.1). The protrusions (16) preferably are elongated in the die bore (12.2), that is, in the direction of travel of the punch, and are spaced downwardly from the die opening by a short distance, e.g., about the thickness of the workpiece to be punched, below the die opening (12.1). The protrusions preferably also terminate downwardly at points spaced above the bottom surface (12.3) of the die, the length of the protrusions (16) preferably being on the order of from about ½ to 1½ times the thickness of the workpiece to be punched. The diametrical distance between the sharpened edges (16.1) of the protrusions desirably is not less than the diameter "d" of the punch. The broken-away outline of the punch, when centered in the die, is shown in phantom lines as (14.2) in FIG. 1.

As background, it will be understood that a punch press commonly employs a ram (not shown) which strikes downwardly upon the punch (14), the latter being centered above a die (12) for the purpose of severing a slug (18) from a workpiece. The die commonly is fixed rigidly in place, and the punch commonly is mounted for reciprocation within a punch sleeve. The punch may be provided with a stripper plate (not shown) and a stripping spring to facilitate upward removal of the punch from the workpiece during the retraction step in the punching cycle. During a typical punching operation, a workpiece is advanced over the top of the die and beneath the punch. A ram is brought down with great force upon the punch, first forcing the punch and punch guide downwardly against the workpiece and in the same stroke continuing to drive the punch downwardly through the workpiece. As the ram retreats upwardly, the stripper spring pulls the punch upwardly and outwardly through the hole formed in the workpiece, the stripper plate operating to keep the edges of the workpiece from following the punch upwardly, and the punch and punch guide then retreat upwardly slightly to permit a new section of workpiece to be moved between it and the die. Punching operations of this general type are known to the art, as exemplified in Wilson and Rosene U.S. Pat. No. 4,248,111.

Since the dimensions of the die generally are slightly larger than the dimensions of the punch, as discussed above, the dimensions of the hole formed in the workpiece on the punch side will be slightly less than the dimensions of the hole on the die side of the workpiece. A workpiece is shown at W in FIG. 3, with the punch side designated "P" and the die side as "D". FIG. 3 depicts the punch (14) as it moves through the thickness of the workpiece during a punch cycle. At the punch position shown in FIG. 3, the slug (18) has been completely severed from the workpiece, even though the punch has not moved through the entire workpiece thickness, and the tapered edges of the workpiece and the slug resulting from the difference in dimensions between the punch rim (14.1) and die opening (12.1) are clearly visible. It will be understood that, for purposes of clarity, the dimensional differences between the punch and die have been exaggerated in FIGS. 1–6 for the purpose of showing the tapered edges of the slug and of the workpiece hole.

Figure 4:
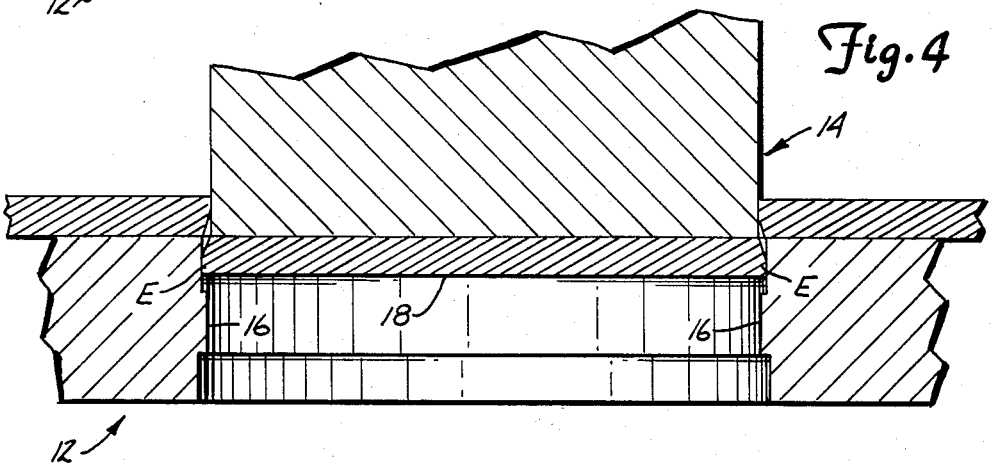
FIG. 4 is a view similar to that of FIG. 3 but showing the punch further extended into the die.
Figure 5:
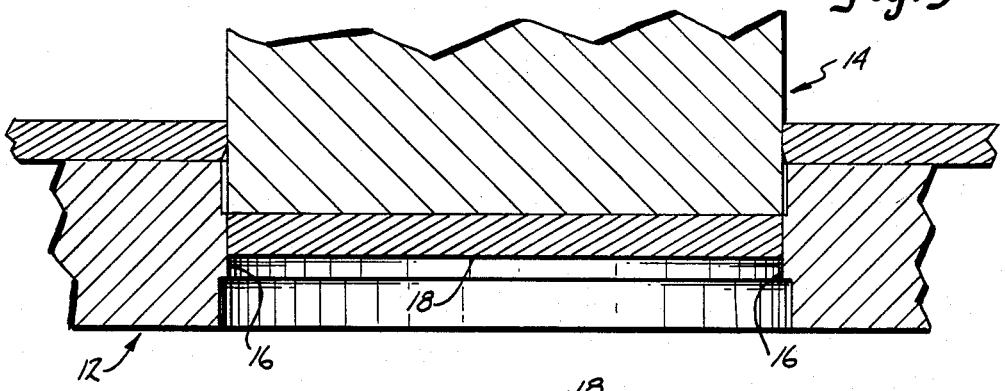
FIG. 5 is a view similar to that of FIGS. 3 and 4 but showing the punch yet further extended into the die.
Figure 6:
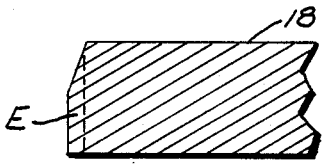
FIG. 6 is an enlarged, broken-away, cross-sectional view of a slug.

In FIG. 4, the punch is shown in a position where it is advanced through the entire thickness of the workpiece, and the slug (18) has been separated completely from the workpiece. As the punch continues downwardly, the expanded annular periphery (designated as "E" in the drawing) of the slug comes into contact with and is impaled upon the protrusions (16) of the die (12). As will now be understood, the protrusions (16) extend preferably only into the expanded annular peripheral portion "E" of the slug that extends beyond the respective dimensions of the punch rim (14.1). Slight deformation of the periphery "E" of the slug (18) results, and the slug is thus held in the die at the position shown in FIG. 5. The punch now retracts upwardly, as explained above, and a new section of workpiece may be inserted between the punch and die. It will be understood that on the subsequent punching operation, the slug (18) will be pushed downwardly between the protrusions (16), the periphery "E" of the slug approaching and being pushed beyond the bottom end of the protrusions whereupon, no longer being held by the protrusions, the slug can fall freely downwardly out of the die. The vertical length of the protrusions (16) may be varied as desired, but for efficiency, it is desired that this length be made such that not more than about two slugs may be stacked within the die and held by the protrusions at any one time. As each new slug is punched and is impaled downwardly upon the protrusions, a slug from a previous punching operation is freed from the protrusions and drops downwardly out of the die.

It will be understood that the punch, in its downward travel, must proceed far enough so as to impale the slug (18) upon the protrusions (16). The length of travel of the punch, and the spacing of the protrusions beneath the die opening (12.2), may be adjusted as desired to accomplish this purpose.

The embodiment of FIGS. 1 and 3–5 depicts a pair of diametrically opposed protrusions within the periphery of a circular die bore. It will be understood that only one protrusion need be used, particularly for smaller die openings, the slug in its downward travel being impaled upon the protrusion at one side and being held snugly against the bore of the die on the other side. A plurality of protrusions may be employed particularly for large die sizes and desirably are spaced appropriately (equiangularly in the case of a circular die opening) about the periphery of the die bore.

With reference again to FIG. 2, it has been explained above that the protrusions (16) extend downwardly but desirably are spaced above the bottom surface (12.3) of the die. In a preferred embodiment, the dimensions of that section of the die bore (12.4) extending below the protrusions (16) may be made slightly larger than the die bore (12.2) adjacent the die opening (12.1) to provide a relief, preferably outwardly tapered, for slugs to fall free from the die once the slugs have been freed from the protrusions (16).

The distance that a protrusion extends inwardly of a die bore depends largely upon the clearance between the punch and die opening, that is, the difference in the relative dimensions of the punch and die opening. The clearance of the punch and die of FIG. 2, for example, would be the difference between "D" and "d". Although one or more protrusions may extend inwardly of the die bore to contact and deform the edge of a slug throughout its thickness, the protrusions preferably encounter and deform only the expanded periphery of the slug. In general, the dies and punches of the invention may handle a wide range of workpiece thicknesses, although workpiece thicknesses in the range of about 0.7 mm. to about 7 mm. are preferred, the protrusions employed extending interiorly from the die bores by distances ranging from about 0.02 mm. to about 0.9 mm.

For such workpiece thicknesses, the distance that protrusions should extend inwardly at the die bore ("protrusion extension") may be roughly calculated by the formula $$\text{Protusion extension} = \tfrac{1}{2} \times \text{clearance} - 0.025 \text{ mm.}$$

In a typical punching operation, the diameter of a circular punch may be 2 cm. and the thickness of the workpiece may be 1 mm. If the die diameter is to exceed the punch diameter by 20% of the thickness of the workpiece, then the die diameter would be approximately 2.02 cm., the clearance would be 0.2 mm., and the radial width of the expanded periphery "E" of the slug (FIG. 6) would be approximately 0.1 mm. Assuming (FIG. 2) that the diameter of the bore (12.2) is the same as the diameter of the die opening (12.1), the projections (16.1) would extend radially inwardly of the bore by a distance of about $\frac{1}{2}$ (0.2 mm.)−0.025 mm.=0.075 mm. As a result, the grooves formed by this die in the edge of the slug would be very fine and would extend upwardly along the edge of the slug only within its expanded periphery; that is, the upper surface of the slug, having the same dimensions as the punch, would not be contacted by the protrusions. Preferably, the protrusions extend inwardly of the die so as to protrude into the expanded periphery of the slug a distance ranging from about 40% to about 80% of the width of the expanded periphery.

Figure 2:
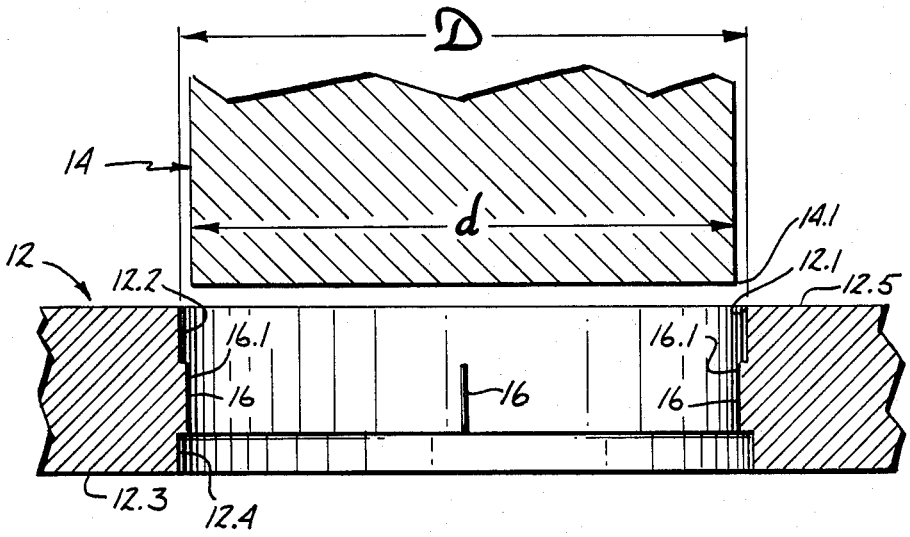
FIG. 2 is a broken-away, diagramatic, cross-sectional view of a punch and die of the invention.
Figure 3:
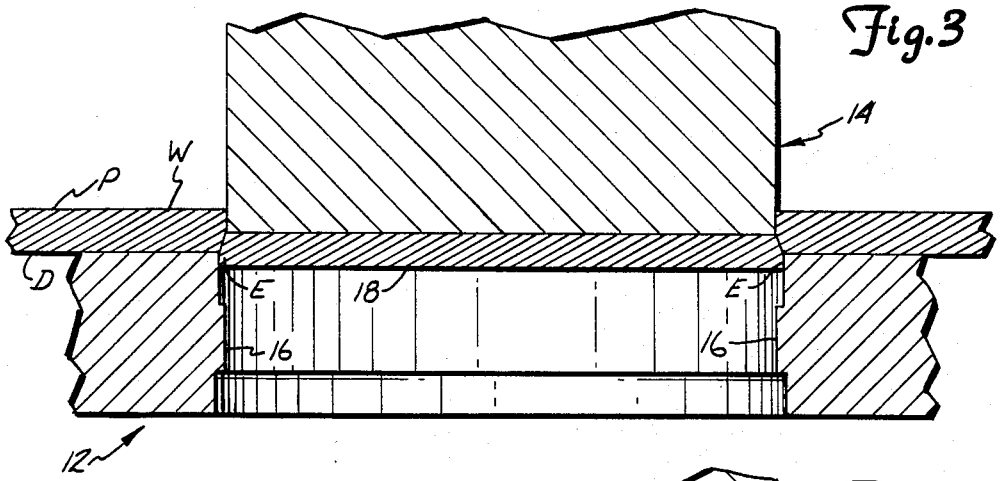
FIG. 3 is a broken-away, diagramatic view of a punch and die of the invention and showing the punch as it enters a workpiece during a punching operation.

With reference to FIGS. 7 and 8, a die (20) similar to that shown in FIGS. 1 and 2 is depicted, but the protrusions (20.1) extending inwardly of the die bore (20.2) are generally rectangular in shape as seen from above, and accordingly have pairs of sharp edges of which one is shown at (20.3) for gripping the annular portion "E" of a slug. The embodiment of FIGS. 9 and 10 is similar to that of FIGS. 7 and 8, the die (22) in this embodiment having a generally rounded or circular protrusion (22.1) extending inwardly of its bore (22.2). Referring now particularly to FIG. 10, the protrusion if desired may have a tapered upper portion designated (22.3) to more easily receive the slug.

As pointed out above, the dies of the invention may be provided with die openings having a variety of shapes and sizes, and may employ a plurality of protrusions of varying shapes protruding inwardly of the hole formed through the die. FIG. 11 exemplifies a die (24) having a generally rectangular hole (24.1) formed through its thickness, the side walls (24.2) of the hole beneath the upper die opening being provided with six substantially equally spaced and balanced protrusions (24.3) having a generally triangular shape as viewed from above.

Although the protrusions may be added, as by welding, to existing dies, the dies of the invention, including the protrusions, desirably are integrally formed from single blanks of steel or other metal by the known method of electrical discharge machining in which electrical discharges from shaped electrodes erode the blanks to provide the die openings, bores and protrusions.

When a die opening such as that shown in (12.1) in FIG. 2 has become dulled through repeated usage, the sharpening operation commonly involves grinding or milling the upper surface of the die to provide a new, sharp die opening edge. The thickness of the die is thus reduced slightly. Because the protrusions (16) are spaced beneath the upper surface (12.5) of the die, typical dies can be resharpened several times before the upper edge of the protrusions (16.1) is reached. When this occurs, the upper ends of the protrusions may themselves be ground down to provide the desired vertical spacing between the protrusions and the upper surface (12.5) of the die.

While a preferred embodiment of the present invention has been described, it should be understood that various changes, adaptations and modifications may be made therein without departing from the spirit of the invention and the scope of the appended claims.

What is claimed is:

1. A punch press comprising a punch and a die having an opening receiving the punch during punching and retraction steps in a material-punching operation, the die having a face normally facing the punch, and including at least two inwardly-extending, elongated protrusions positioned and dimensioned to encounter and grip solely the peripheral edge of a punched slug of workpiece material that exceeds the corresponding punch dimension during the punching step and to restrain the slug from following the punch during the retraction step, the at least two protrusions being elongated in the direction of punch travel and being spaced in the direction of punch travel from said die face.

2. The die of claim 1 wherein such protrusions are spaced about the interior periphery of the die opening.

3. The punch press of claim 1 wherein the protrusions are provided with a rounded slug-contacting surface.

4. The punch press of claim 1 wherein the protrusions are provided with a sharpened slug-contacting edge.

5. The punch press of claim 1 wherein the protrusions are provided with at least two sharp edges for contacting the slug.

6. The punch press of claim 1 wherein said protrusions are formed as an integral part of said die.

* * * * *